US010543523B2

(12) United States Patent
Breton et al.

(10) Patent No.: US 10,543,523 B2
(45) Date of Patent: Jan. 28, 2020

(54) FORGING TOOL FOR THE MANUFACTURING OF A SHAPED ROLLED RING, NOTABLY FOR THE MANUFACTURE OF A TURBOMACHINE DISC

(71) Applicant: SAFRAN AIRCRAFT ENGINES, Paris (FR)

(72) Inventors: Michel Breton, Rieux (FR); Samuel Sicot, Osny (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/114,918

(22) PCT Filed: Feb. 2, 2015

(86) PCT No.: PCT/FR2015/050229

§ 371 (c)(1),
(2) Date: Jul. 28, 2016

(87) PCT Pub. No.: WO2015/118249

PCT Pub. Date: Aug. 13, 2015

(65) Prior Publication Data

US 2016/0339504 A1 Nov. 24, 2016

(30) Foreign Application Priority Data

Feb. 5, 2014 (FR) ..... 14 50889

(51) Int. Cl.
*B21H 1/00* (2006.01)
*B21H 1/06* (2006.01)

(52) U.S. Cl.
CPC ..... *B21H 1/06* (2013.01)

(58) Field of Classification Search
CPC .... B21B 5/00; B21H 1/06; B21H 1/08; B21H 1/10; B21H 1/12; B21H 1/18
See application file for complete search history.

(56) References Cited

U.S. PATENT DOCUMENTS

2006/0026832 A1 2/2006 Bergue et al.

FOREIGN PATENT DOCUMENTS

| | | | | |
|---|---|---|---|---|
| CN | 201186286 Y | | 1/2009 | |
| CN | 202963336 U | | 6/2013 | |
| DE | 235 577 A1 | | 5/1986 | |
| DE | 299 07 807 U1 | | 7/1999 | |
| DE | 299 07 807 U1 | | 8/1999 | |
| EP | 1 623 792 A1 | | 2/2006 | |
| FR | 349947 | | 5/1904 | |
| FR | 349947 A | * | 7/1905 | ..... B21H 1/08 |
| JP | 3-268833 A | | 11/1991 | |

(Continued)

OTHER PUBLICATIONS

International Search Report dated May 12, 2015 in PCT/FR2015/050229 filed Feb. 2, 2015.

(Continued)

*Primary Examiner* — Debra M Sullivan
(74) *Attorney, Agent, or Firm* — Oblon, McClelland, Maier & Neustadt, L.L.P.

(57) ABSTRACT

Mandrels for rolling a ring include recesses for receiving the ring, which have rounded parts at the connection between the various faces, so as to avoid the formation of sharp angles on the rolled ring and the accidental formation of cracks.

10 Claims, 2 Drawing Sheets

(56) References Cited

FOREIGN PATENT DOCUMENTS

| | | | |
|---|---|---|---|
| JP | 10-277692 | A | 10/1998 |
| JP | 2002-86241 | A | 3/2002 |

OTHER PUBLICATIONS

French Search Report dated Sep. 23, 2014 in FR 1450889 filed Feb. 5, 2014.

Julian M. Allwood et al., "The Development of Ring Rolling Technology," Steel Research Int. 76, No. 2/3 (2005).

* cited by examiner

FORGING TOOL FOR THE MANUFACTURING OF A SHAPED ROLLED RING, NOTABLY FOR THE MANUFACTURE OF A TURBOMACHINE DISC

BACKGROUND OF THE INVENTION

Field of the Invention

One aspect of the present invention is a forging tool for manufacturing a shaped rolled ring, in particular for manufacturing a turbomachine disc, accomplished with such a tool.

The object of the invention is to improve a blank step of manufacturing certain turbomachine discs where recourse is had to forging, and more precisely to rolling. A blank of the disc in the form of a ring, heated to a sufficient temperature, is introduced into a tool that reduces its cross section, while increasing the radius of the ring. The process is thus to obtain discs with a relatively large diameter, with large bores at the centre. The manufacture of the disc is next continued by other methods. A tool with two mandrels, without however the original features of the invention, is described in DE 299 07 807 U.

The use of certain new alloys is envisaged for increasing the strength of the discs. It is a case for example of an alloy based on nickel or nickel-chromium, such as the superalloys of the Rene 65 or AD730 type.

Description of the Related Art

The temperature window suitable for forging is much smaller for such alloys than for conventional alloys such as Inconel 718, normally used up until the present time for such applications. Thus the parts coming out of the furnace and subjected to rolling take little time to cool too much in air, and it is then observed that cracks may appear in the rolled ring. The quality of the ring is therefore compromised since the defects created do not disappear during the following manufacturing steps.

At the present time, the rolling operation therefore in practice takes place in several steps, between which the blank of the disc is put back to heat at the required temperature. This may greatly extend the manufacturing time, since a plurality of such re-heatings (typically from one to three) are in practice necessary. In some variants, their number is reduced by accepting a start of appearance of cracks, which are removed then by grinding the blank at those points before resuming heating, and then rolling. It is however obvious that the grinding itself consumes time, as well as material.

BRIEF SUMMARY OF THE INVENTION

With the invention, it is consequently sought to avoid the appearance of cracks during rolling of a metal ring, but without needing to carry out reheating, or in any case with only a smaller number of re-heatings, and without having to carry out manual corrective machining such as grinding.

To summarise, one aspect of the invention is a tool for rolling a part in the form of a ring, comprising two mandrels turning about axes parallel to each other and each comprising a circular recess for receiving the ring, the recesses comprising a bottom face and lateral faces, characterised in that the bottom face of each of the mandrels is connected to the lateral faces by curved portions having radii of curvature of between 10 and 20 mm.

Typically, the rings are 300 mm to 1500 mm in outside diameter on emerging from this rolling, and are made from an alloy based on nickel or nickel-chromium. The radii of curvature may typically be preferably between 12 mm and 15 mm. And, according to a usual embodiment of the invention, the bottom face is cylindrical or conical, defined by a rectilinear generatrix, and the lateral faces are conical and also defined by rectilinear generatrices.

The essential technical effect is that the rings, the cross section of which is essentially polygonal and generally quadrangular between the bottom faces defining their inside radius and their outside radius, and the lateral faces defining their lateral sides, normally acquire connections with sharp angles between these faces during rollings carried out with the known tools. However, in the invention, these connections arrive in front of the curved portions, which squash the sharp angles and maintain the connections to radii of curvature. Since the cracks first form at the sharp angles, they can no longer appear, or no longer as easily, with the invention.

Another aspect is a method for manufacturing a turbomachine disc, comprising a blank step by rolling where the disc arrives in the form of a ring, a cross section of which is reduced by rolling, characterised in that said step is performed with a tool according to the above, the ring having an essentially polygonal cross section and comprising corners situated on the curved portions, and also curved during the method.

BRIEF DESCRIPTION OF THE SEVERAL VIEWS OF THE DRAWINGS

The invention will now be described more completely, in its various aspects and purely illustratively, in relation to the following figures.

DETAILED DESCRIPTION OF THE INVENTION

Figure 1:
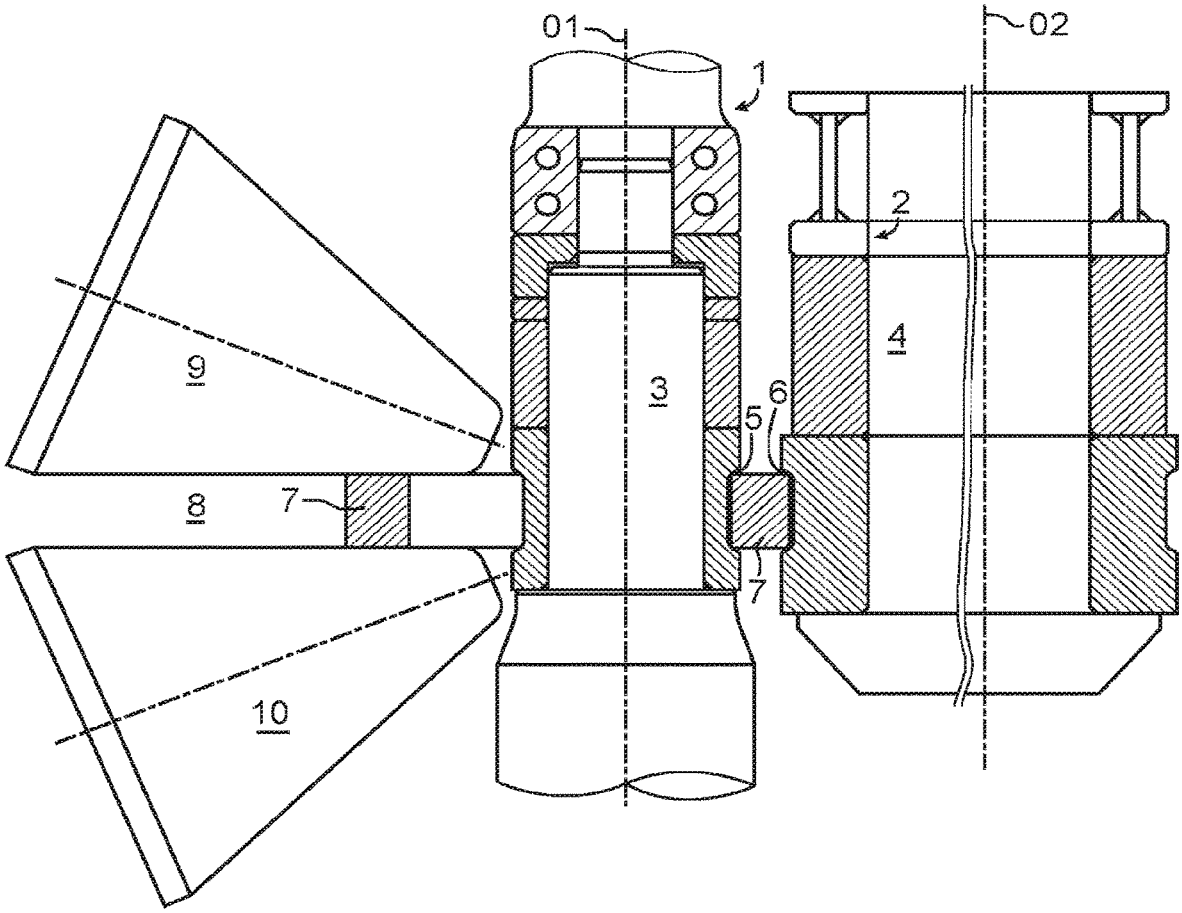
FIG. 1 is a general view of the tool used.

The invention forms part of a method for manufacturing a turbomachine disc, in particular with a large diameter, and constitutes a first step of this method, the following ones of which, which are not changed, will not be described. It relates to the rolling of a ring 7, which is a blank of the disc, to reduce its cross section, while increasing its diameter. It has recourse to a tool that comprises, as shown by FIG. 1, a driving mandrel 1 and a loose mandrel 2, situated side by side, and turning about parallel axes O1 and O2, vertical in the figure. The driving mandrel 1 contains a shaft 3, which belongs to the drive motor, not shown, and which rotates it, whereas the loose mandrel 2 contains a shaft 4, mounted freely in bearings. The mandrels 1 and 2 each comprise a recess 5 or 6 circular about the respective axis O1 or O2, the recesses 5 and 6 being situated at the same height and therefore having portions coming face to face. The ring 7 to be rolled is held there between the recesses 5 and 6. It moreover extends around the loose mandrel 2, and its part most opposite to the space between the sleeves and 2, where the rolling occurs, extends at a distance from said loose mandrel 2, the diameter of which is smaller, and in a horizontal rebate 8, delimited between two supports 9 and 10.

Figure 2:
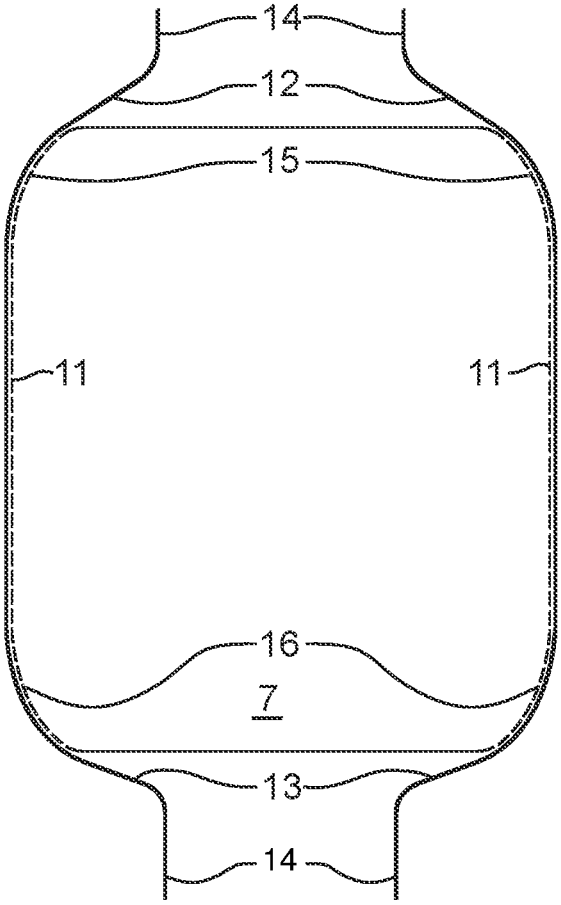
FIG. 2 is an enlargement of its essential parts.

FIG. 2 shows that the recesses 5 and 6 each comprise a bottom face 11, two lateral faces 12 and 13 being connected to an external face 14 of the respective mandrel 1 or 2. The bottom faces 11 are cylindrical, and the lateral faces 12 and 13 conical, all these faces being defined by rectilinear generatrices. In a variant, the faces of the recesses 5 and 6 could be defined by other shapes, provided that sharp angles are avoided for reasons that will now be detailed: in accordance with the invention, the bottom faces 11 are joined to the lateral faces 12 and 13 by respective connections 15 and 16, which are portions of surfaces the cross sections of which are curved, with a concavity opening towards the outside of the recesses 5 and 6, and have a radius of curvature that can be chosen, in the envisaged application, advantageously between 10 and 20 mm, and even more advantageously from 12 to 15 mm, for diameters of blanks typically between 300 and 1500 mm, at the end of rolling. The connections and 16 provide a transition without an angle, and therefore with a continuous variation in slope, between the faces that they connect.

Figure 3:
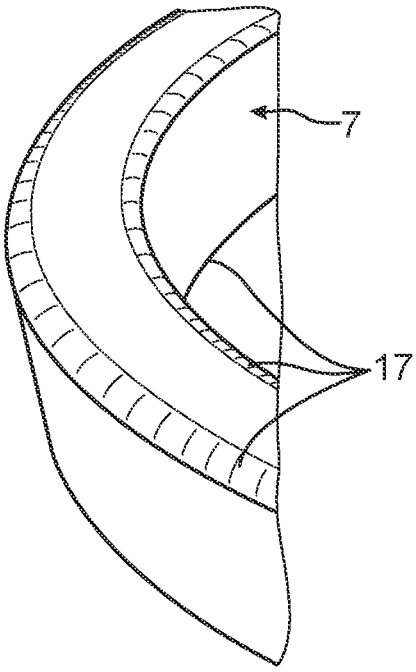
FIG. 3 is view of the product obtained.

The ring 7 has an approximately polygonal and rectangular cross section, the internal and external faces of which are tangent to the faces of the bottom 11, and the lateral faces of which extend in front of the lateral faces 12 and 13 of the recesses. The connections of the lateral faces to the internal and external faces should form sharp angles, at the corners of the cross section of the ring 7, but the rolling produced by the mandrels 1 and 2, which compresses the cross section of the ring 7, also crushes its corners and forces them to be modelled to the form of the portions 15 and 16, which gives the appearance in FIG. 3, where the faces of the ring 7 are delimited by the rounded connections 17. This arrangement avoids forming, during rolling, right angles that cool very quickly, leading locally to deforming the material outside its forgeability window and consequently creating cracks. This arrangement therefore prevents cracks from forming and therefore ensures good quality of forging, even at the lower limit of the forgeability temperature range.

The invention claimed is:

1. A method for manufacturing a turbomachine disc, comprising:

providing a ring including an alloy based on either nickel or nickel and chromium;

heating the ring up to a forgeability temperature window;

placing the heated ring in a tool; and performing a rolling step of the heated ring which reduces a cross section of the ring, the rolling step being performed by the tool, which comprises two mandrels turning about axes parallel to each other, wherein each of the mandrels comprises a circular, the ring passing between the recesses, each of the recesses comprising a bottom face and lateral faces, wherein the bottom face of each recess of the mandrels is connected to the lateral faces by curved portions having radii of curvature of between 10 mm and 20 mm, wherein the ring presents an essentially polygonal cross section and comprises corners which are situated on the curved portions during the placing, wherein the corners of the ring are curved during the rolling step, wherein the ring presents a diameter between 300 mm and 1500 mm after the rolling step, wherein sharp angles at the corners of the ring are crushed by said curved portions and consequently cracks are prevented from forming, and wherein the rolling step is carried out without any reheating.

2. The method for manufacturing a turbomachine disc according to claim 1, wherein the radii of curvature of the curved portions are between 12 and 15 mm.

3. The method for manufacturing a turbomachine disc according to claim 1, wherein the bottom face is cylindrical or conical, defined by a rectilinear generatrix, and the lateral faces are conical, defined by rectilinear generatrices.

4. The method for manufacturing a turbomachine disc according to claim 1, wherein the curved portions, which have a concavity opening up towards an outside of the recesses, connect the lateral faces by a profile with no angle.

5. The method for manufacturing a turbomachine disc according to claim 1, wherein the disc includes a Rene 65 super alloy.

6. The method for manufacturing a turbine disc according to claim 1, wherein the disc includes an AD730 super alloy.

7. The method for manufacturing a turbomachine disc according to claim 1, wherein the axes of the two mandrels are vertical, the tool further comprises two supports between which a horizontal rebate is delimited, and a part of the ring which is most opposite to a space between the mandrels extends in the horizontal rebate.

8. The method for manufacturing a turbomachine disc according to claim 1, wherein the rolling step is performed without carrying out any corrective grinding of the ring after the rolling step.

9. A method for manufacturing a turbomachine disc, comprising:

providing a ring including an alloy based on either nickel or nickel and chromium;

heating the ring up to a forgeability temperature window;

placing the heated ring in a tool; and performing a rolling step of the heated ring which reduces a cross section of the ring, the rolling step being performed by the tool, which comprises two mandrels turning about axes parallel to each other, wherein each of the mandrels comprises a circular recess, the ring passing between the recesses, each of the recesses comprising a bottom face and lateral faces, wherein the bottom face of each recess of the mandrels is connected to the lateral faces by curved portions having radii of curvature of between 10 mm and 20 mm, wherein the ring presents an essentially polygonal cross section and comprises corners which are situated on the curved portions during the placing, wherein the corners of the ring are curved during the rolling step, wherein the ring presents a diameter between 300 mm and 1500 mm after the rolling step, and wherein sharp angles at the corners of the ring are crushed by said curved portions and consequently cracks are prevented from forming.

10. The method for manufacturing a turbomachine disc according to claim 9, wherein the curved portions have radii of curvature of between 12 mm and 15 mm.

* * * * *